US007306837B2

(12) United States Patent
Hagen et al.

(10) Patent No.: US 7,306,837 B2
(45) Date of Patent: Dec. 11, 2007

(54) HEAT RESISTANT LABELED PRODUCT AND METHOD

(75) Inventors: Ronald G. Hagen, Larsen, WI (US); Kristi B. Carr, Neenah, WI (US); Robert C. Zietlow, Neenah, WI (US)

(73) Assignee: WS Packaging Group, Inc., Algoma, WI (US)

( * ) Notice: Subject to any disclaimer, the term of this patent is extended or adjusted under 35 U.S.C. 154(b) by 249 days.

(21) Appl. No.: 10/834,734

(22) Filed: Apr. 29, 2004

(65) Prior Publication Data

US 2005/0244595 A1 Nov. 3, 2005

(51) Int. Cl.
*B32B 9/00* (2006.01)
*B65D 65/28* (2006.01)
*B42D 15/00* (2006.01)

(52) U.S. Cl. ..... 428/40.1; 428/41.7; 428/42.1; 428/42.2; 428/43; 428/354; 283/81

(58) Field of Classification Search ..... 428/40.1–42.3, 428/43, 343, 354; 283/81
See application file for complete search history.

(56) References Cited

U.S. PATENT DOCUMENTS 4,281,762 A * 8/1981 Hattemer ..... 206/390
4,449,633 A 5/1984 Johnson et al.
4,479,838 A 10/1984 Dunsirn et al.
4,621,442 A 11/1986 Mack
4,621,837 A 11/1986 Mack
4,690,720 A 9/1987 Mack
4,724,166 A 2/1988 deBruin
4,744,591 A 5/1988 Instance
4,747,618 A 5/1988 Instance
4,767,654 A 8/1988 Riggsbee
4,836,438 A 6/1989 Rigby
4,863,772 A 9/1989 Cross
4,866,786 A 9/1989 Nagler
4,915,994 A * 4/1990 Begelfer et al. ..... 428/40.6
4,991,878 A * 2/1991 Cowan et al. ..... 283/81
5,019,436 A 5/1991 Schramer et al.
5,078,817 A * 1/1992 Takagaki ..... 156/73.1
5,350,612 A 9/1994 Stern et al.
5,565,228 A 10/1996 Gics
5,843,547 A * 12/1998 Kulper et al. ..... 428/40.1
6,307,192 B1 10/2001 Ulfstedt et al.

* cited by examiner

*Primary Examiner*—Patricia L Nordmeyer
(74) *Attorney, Agent, or Firm*—Reinhart Boerner Van Deuren s.c.

(57) ABSTRACT

An ovenable package contains an ovenable product and has a display surface mounting a self-adhesive ovenable label, for example, presenting a coupon or other product promotional item. The ovenable label has at least two layers including a promotional layer defining the text and graphics of the promotional item. The promotional layer can be paper covered by a transparent, heat resistant barrier layer, preferably made of polyester, adhered to the ovenable package directly or to a heat resistant base layer which is adhered to the ovenable package. In this case, one or more layers of the label can be perforated to define a lift off section. Or, the promotional layer itself can be the outer heat resistant layer releasably adhered to the base layer. A labeling method of providing the promotional item to a consumer of the ovenable product is also disclosed.

35 Claims, 3 Drawing Sheets

HEAT RESISTANT LABELED PRODUCT AND METHOD

CROSS-REFERENCE TO RELATED APPLICATION

Not applicable.

STATEMENT OF GOVERNMENT SPONSORED DEVELOPMENT

Not applicable.

BACKGROUND OF THE INVENTION

1. Technical Field

This invention relates to labels and in particular to labels for ovenable products.

2. Description of the Related Art

Various types of promotional items are used for marketing consumer products. One common technique is to attach the promotional items directly to the products or product packaging. The promotional items can be adhesive backed labels that are either removable or have tear-away panels. These labels can be, for example, coupons that consumers can peel off the product or peel-off tokens or entry forms for a promotional game or giveaway.

Some such labels have multiple layers releasably adhered together. For example, U.S. Pat. No. 4,479,838, hereby incorporated by reference as though fully set forth herein, defines a multiple ply label construction with a transparent base sheet to which is releasably adhered a non-transparent top sheet printed to define a coupon, for example. These two layers are adhered to a release liner. Such a label is used by peeling the base sheet (with the top sheet attached) from the release liner and adhering it to a product. The top sheet can later be removed from the base sheet, for example when the purchaser of the product redeems the coupon.

These labels are often made and applied using automated line processes. Thus, large quantities of labels are formed in a single file line of labels on a continuous backing web that is either wound or folded, for example, in a Z-fold configuration. Individual labels can be cut from the web and applied to the products or stacked for storage or transport.

Some products, such as some frozen pizzas or packaged meals ("TV dinners"), are designed to be heated in a conventional oven or a microwave oven while in some or all of the product packaging. Such "ovenable" packages or containers, for example, are disclosed in U.S. Pat. Nos. 4,449,633; 4,836,438; 4,866,786; 5,565,228; and 6,307,192, the disclosures of which are hereby incorporated by reference herein. Such ovenable packages can be disposable trays, pans or other containers made of paper, aluminum foil, plastic or other materials capable of sustaining the heat from conventional, convection or microwave ovens, which produce heat typically in the range of 350-500° F. The use of the packaging in such high heat environments presents a problem for marketers in that conventional labels may break down in some way, for example they may melt or be singed by the heat, which can distort, discolor or otherwise obscure the print on the label. Or, the adhesive may fail from the high heat causing the label to separate from the package while it is cooking. Thus, a high temperature label is needed.

BRIEF SUMMARY OF THE INVENTION

In one aspect the present invention provides a product with an item to be heated in an oven. The product item is contained in an ovenable package with a display surface to which is adhered an underside of an ovenable label having a promotional layer that is at least in part removable from the ovenable package. Preferably, the display surface where the ovenable label is adhered is located at the exterior of the ovenable package.

The ovenable label can take many forms, all of which require the use of heat resistant materials at least for the exposed layers of the label. Heat resistant plastic, such as a suitable polyester, is preferred which can withstand temperatures of 500° F. or more, as can be used in conventional cooking ovens, without melting or combusting. Inner layers not directly exposed to the heat need not have any special heat resistant characteristics, such that papers and other readily printable materials can be used. The heat resistant materials can be selected to have an auto-ignition point higher than that of paper which is 451° F., and more preferably above 500° F.

In one preferred form, the label has two layers, a promotional layer disposed between the display surface and a barrier layer. The promotional layer can be single ply or folded or stacked to form multiple plies. The promotional layer can be made of a printable paper or plastic, and as mentioned, the barrier layer can be made of a heat resistant, preferably transparent, polyester. The barrier layer can be larger than the promotional layer and preferably backed with a transparent, heat resistant pressure sensitive adhesive adhered to a top side of the promotional layer as well as the display surface. The barrier layer can be perforated to allow separation of a lift off section (carrying some or all of the promotional layer) along the perforations. "Wings" of the barrier layer (and possibly the promotional layer) are left adhered to the display surface. For example, there can be two, three, four or more perforation lines defining the sides of the lift off section depending on its intended shape.

A third, base layer can be added to the two-layer label construction described above. In this case, the base layer is preferably a heat resistant plastic, polyester for example, and it is backed with a transparent heat resistant pressure sensitive adhesive adhered to the display surface. The top side of the base layer supports the promotional layer and the barrier layer encloses the promotional layer and adheres to the base layer along one or more sides.

In another form, the ovenable layer can have two heat resistant plastic, preferably polyester, layers. The top layer could be the promotional layer having the promotional indicia printed thereon and the bottom layer would be the base layer adhered by pressure sensitive adhesive to the display surface and to which the promotional layer is adhered. A transparent and heat resistant adhesive can be used so that the entire promotional layer can be peeled away readily from the base layer and thereby the ovenable package. Using this technique eliminates the need for perforations.

In another aspect the invention provides an ovenable package with an ovenable label and containing a product designed to be heated while inside the package. The ovenable label is adhered to a display surface at the exterior of the ovenable package and includes at least a printed paper layer and a second layer. The second layer can be a heat resistant and transparent top barrier layer adhered directly to the display surface or to a separate base layer with the promotional layer disposed therebetween.

In another aspect the invention provides a method of providing a promotional item to a consumer of an ovenable product. The method includes the steps of obtaining an ovenable package having walls defining an interior space and a display surface (preferably an exterior surface); obtaining an ovenable label; placing the ovenable product into the interior space of the ovenable package; and adhering the ovenable label to the display surface of the ovenable package. The method can further include placing the ovenable package into an oven and cooking the ovenable product; removing the ovenable package from the oven; and peeling the promotional layer of the ovenable layer from the display surface of the ovenable package.

As described, the ovenable label is preferably self-adhesive, and various techniques can be utilized for removing layers or the entire label from the package without damaging the label or tearing the package. The label is particularly suited for attaching coupons or other small promotional items directly to products or product packages. The promotional item can be made of a heat resistant material, or a heat resistant barrier layer can be used to shield a paper, for example, coupon or other item from scorching or melting in a conventional oven or other oven environment. In this way, the promotional item can be removed from the product package after heating in a useable form, such as in the case of a coupon being suitable for redemption.

The advantages of the invention will appear from the following description. In this description, reference is made to the accompanying drawings which form a part hereof and in which there is shown by way of illustration preferred embodiments of the invention. These embodiments do not represent the full scope of the invention. Thus, the claims should be looked to in order to ascertain the scope of the invention.

DETAILED DESCRIPTION OF THE PREFERRED EMBODIMENTS

Figure 1:
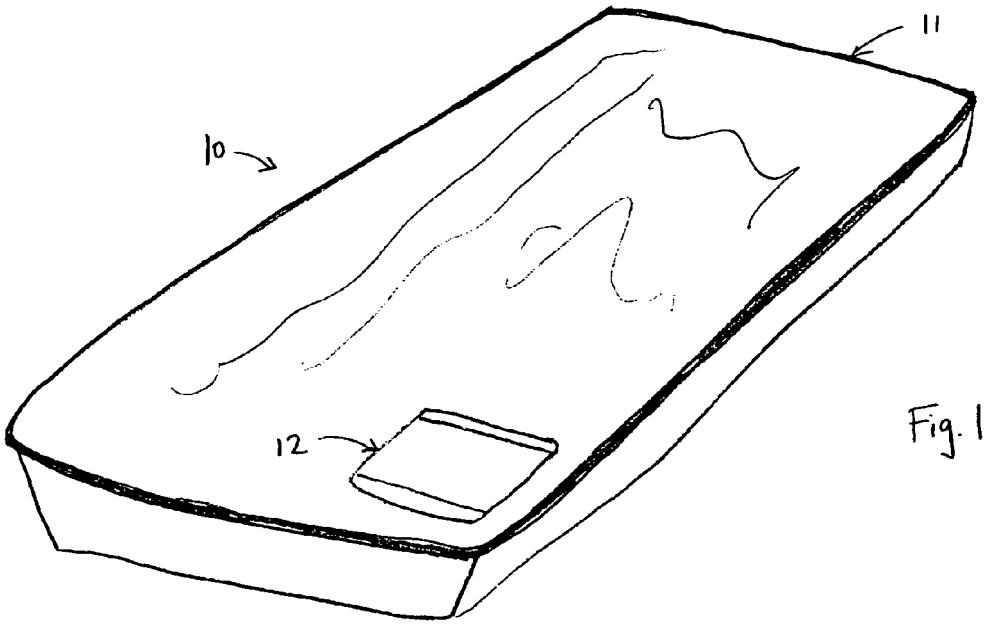
FIG. 1 is a perspective view of an ovenable product package to which a high temperature ovenable label according to the present invention is adhered.

FIG. 1 shows an ovenable product 10 disposed within the interior of an ovenable package 11 to an exterior display surface of which is adhered a self-adhesive ovenable label 12 according to the present invention. The use of the term "ovenable" herein means that it can be heated in an oven without significant deterioration, such as combustion, melting or discoloration. The term "oven" can include conventional gas or electric ovens, convection and microwave ovens and any other type of kitchen oven suitable for heating food. It should be noted, however, that the products need not be foodstuffs and that the invention is intended to cover labeled ovenable packaging for any type of product intended to be heated while in some or all of its packaging. Also, the packaging can be any suitable ovenable package in any form, such as bag, tray, pan, carton or container, such as those disclosed in U.S. Pat. Nos. 4,449,633; 4,836,438; 4,866,786; 5,565,228; and 6,307,192.

Figure 2:
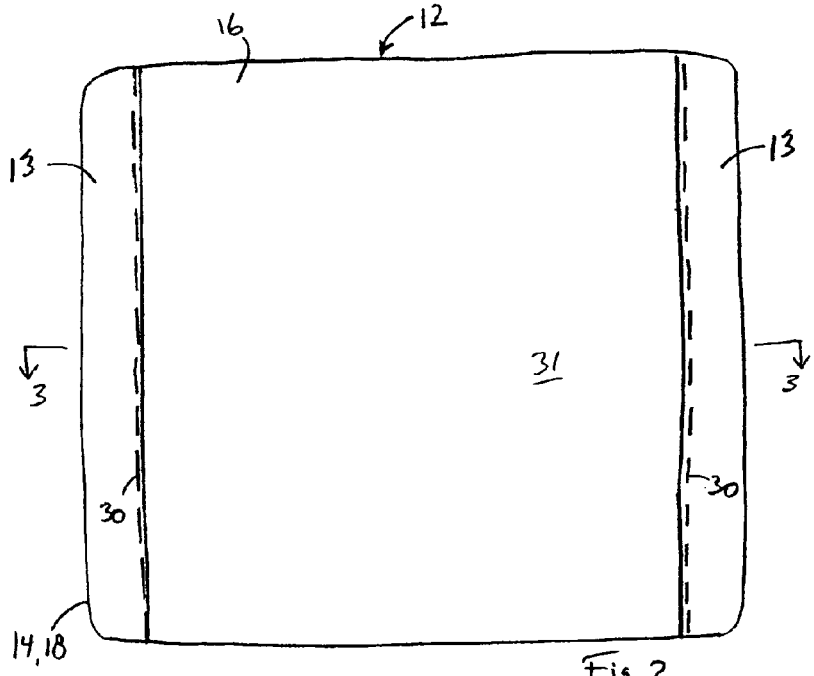
FIG. 2 is a top plan view of one embodiment of the label having a barrier layer lift off section defined between two perforated wings.
Figure 3:
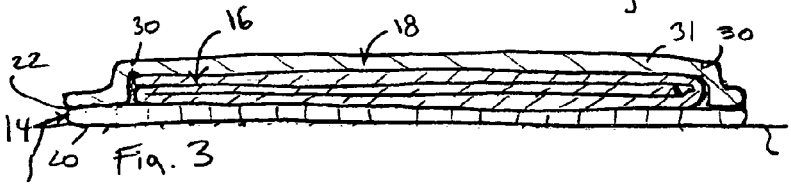
FIG. 3 is a sectional view taken along line 3-3 of FIG. 2.

Referring to FIGS. 2 and 3, a preferred form of the label 12 has three layers, including a base layer 14, a promotional layer 16 and a barrier layer 18. The base layer 14 is preferably transparent and coated at its underside with a pressure-sensitive semi-permanent or permanent heat resistant transparent adhesive 20. The promotional layer 20 is preferably an opaque or non-transparent layer with printed graphics and/or text defining the promotional item, such as a coupon, rebate form, contest entry form or game piece, for example. The barrier layer 18 is a heat resistant, preferably transparent material cut to about the same size as the base layer 14, both of which are larger than the promotional layer 16 such that a pressure sensitive semi-permanent or permanent transparent heat resistant adhesive 22 applied to an underside of the barrier layer 18 can be adhered to portions of the base layer 14 around at least two sides of the promotional layer 16 and thereby encapsulate the promotional layer 16 therebetween (between two side "wings" 13 as illustrated in FIGS. 1-3) and join the label together in a three-layer configuration.

Figure 4:
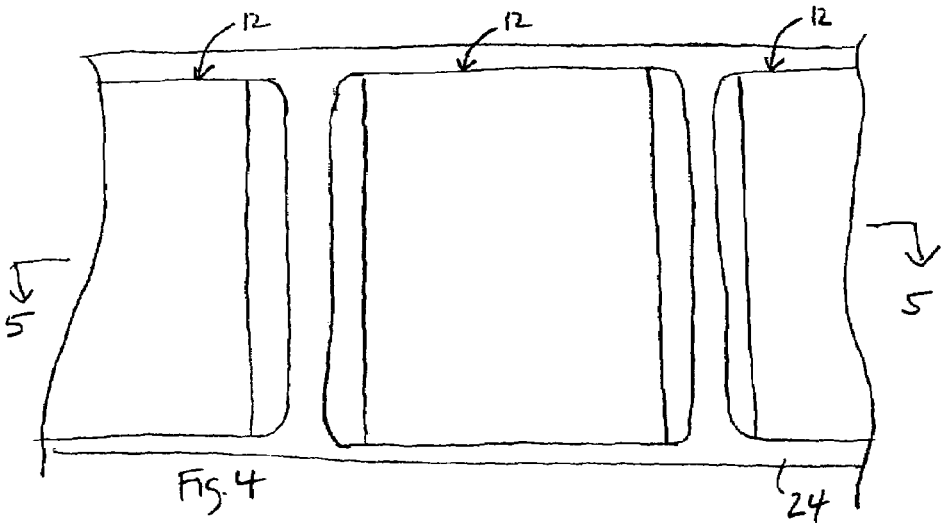
FIG. 4 is a partial top view showing multiple labels on a continuous web release liner.
Figure 5:
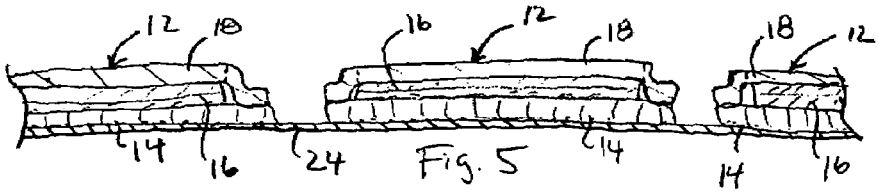
FIG. 5 is a sectional view taken along line 5-5 of FIG. 4.

As shown in FIGS. 4 and 5, multiple labels can be assembled in a continuous line process using a web of release liner 24 to hold the labels. The back side (underside) of the base layer 14 has the pressure sensitive, heat resistant adhesive 20 adhering the label 12 to the release liner 24. As is conventional, the release liner 24 is a continuous spooled web having a smooth, release upper face (e.g., silicone) that releasably receives the pressure sensitive adhesive backing of the base layer 14. The labels can be arranged on the liner so that the wings 13 at the "sides" (spaced apart along the length of the liner), as shown in FIG. 4, or at the top and bottom of each label, rotated essentially 90° from the orientation shown in FIG. 4.

In a preferred form, the base layer 14 is made of a transparent film of polyester and is supplied backed with the release liner 24, with pressure sensitive transparent heat resistant adhesive. For example, a suitable material is 1.5 mil thick polyester with 590 pressure sensitive adhesive and release liner available from Wausau Papers, Mosinee, Wis. The barrier layer 18 is made of thin clear polyester film, and may be supplied as a self wound material backed with pressure sensitive adhesive, such as a suitable acrylic. For example, a suitable material is self wound 1 mil thick polyester #670 with acrylic adhesive available from Adhesive Coated Products of Ohio, Port Clinton, Ohio. In the above described embodiment, the promotional layer 16 need not be made of a heat resistant material since it is essentially encapsulated by the barrier and base layers. Stock kraft paper, preferably surface coated as needed to achieve good printability, can be used, for example 60 pound coated one side paper. Such material has an auto-ignition point of about 451° F., which is the range of temperatures of conventional ovens, however, because it is covered by the barrier and base layers it can be used in environments above its auto-ignition temperature. Depending on the materials selected from the barrier and base layers, the label can be used in 500° F., or higher, temperature environments.

As mentioned, multiple labels can be manufactured in a continuous line process. Specifically, a reel of the barrier layer is unwound. The pressure sensitive adhesive 22 can be applied in liquid form by spraying, rolling, blading or otherwise applying it onto a face of the barrier layer, although a self wound material with the pressure sensitive adhesive 22 pre-applied as disclosed above can be used. A reel of the promotional layer, previously printed with a series of graphics and text (and possibly folded, stacked or bound) so as define a series of the promotional items, is unwound and brought into contact with the adhesive face of the unwound section of barrier layer. Then a reel of the base layer backed with the reel liner is unwound and brought together with this assembly so that the barrier layer adhesive contacts and adheres to the base layer around the promotional layer, for example along opposite sides.

Figure 6:
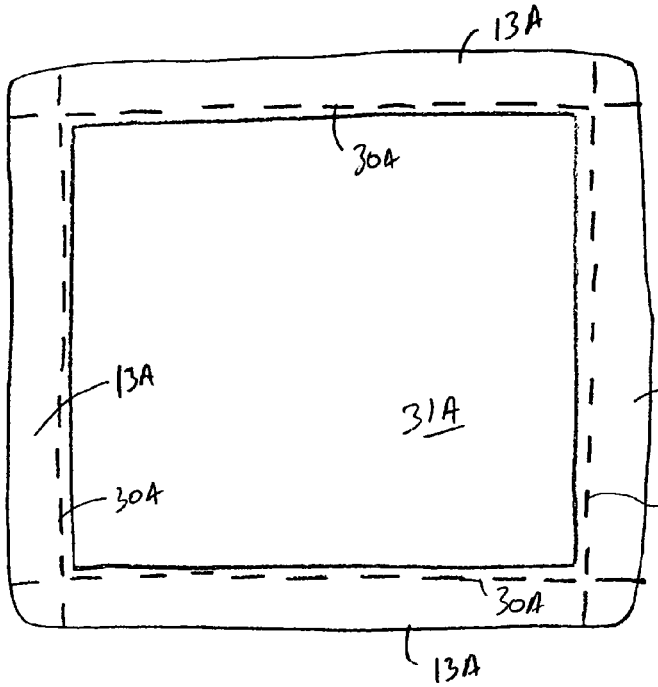
FIG. 6 is a top plan view of another embodiment of the ovenable label with the barrier layer lift section defined between four perforated wings.

In one preferred form, this web assembly is passed through a cutter which perforates (see perforation lines 30 in FIG. 3) the barrier layer just outside of opposite sides of the promotional layer to define a lift off section 31 of the barrier layer. The cutter could also perforate the barrier around all sides of the promotional item. If the promotional layer was formed by a series of individual promotional items applied to the web in spaced relation, the cutter would only perforate the barrier layer, preferably just to the outside of the promotional layer. However, if the promotional layer is a continuous web, then it would be perforated as well so that it would be torn from the label with the lift off section of the barrier layer. FIG. 6 shows an example in which the cutter defines the lift off section 31A by four perforation lines 30A to define four wings 13A which would remain with the ovenable package when the lift off section and the promotional layer (in whole or in part) is removed. It should be noted that the number, configuration and placement of the perforation can be varied to match the configuration of the promotional layer.

The cutter would also cut through the barrier, promotional and base layers but not the release liner so as to define a series of individual labels spaced apart along the release liner. The waste matrix defined between and to the sides of the labels is stripped off of the release liner. Doing this leaves one or more edges of the promotional layer exposed to the heat, however this is not believed to present a problem. If it were found that the edges of a paper promotional layer were singed or discolored at high heats, a heat resistant (printable polyester) promotional layer could be used, or the FIG. 6 embodiment, that has all four edges of the label covered with the barrier layer, could be used so that the promotional layer (the part removed with the lift off section) would not be affected.

If desired the release liner can be cut between the labels to form individual labels backed by a release liner. Or, the individual sheets could be defined by fold lines or perforations so that rather than be separate the sheets remain connected to one another. In this case, the sheets can be folded, for example in a fan or "Z" fold configuration, or wound on a reel.

Each label can be peeled off of the backing sheet individually and attached to a product or packaging by the pressure-sensitive adhesive on the underside of the base layer. The adhesive coating releases from the backing sheet but strongly adheres to the product/packaging in a permanent or semi-permanent manner. Once a label is applied to the product, the heat resistant adhesives allow the ovenable label to remain securely intact and adhered to the ovenable package while the product is heated. Then, the lift off section of the barrier layer along with some or all of the promotional layer can be peeled from the base layer and removed along the perforation lines. The wings will remain adhered to the product, however, in the case where all of the promotional layer is removed with the lift off section, the wings are transparent and do not visually obstruct printing on the product or its packaging.

The invention thus offers product manufacturers a label based method of providing promotional items of the type mentioned herein to consumers of their ovenable products. Product manufacturers can simply place their products in ovenable packages, sealed and dressed as required, and then adhere one or more self-adhesive ovenable labels, in any of the forms mentioned herein or in similar forms, to suitable surfaces of the packages. The ovenable capability of the packages and labels allows the promotional items to be retained to the products while being heated and not removed until after they are removed from the oven. The usuable part of the labels can then be simply peeled off of the packages.

Figure 7:
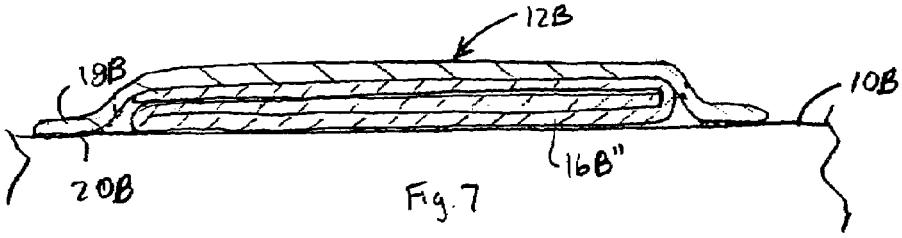
FIG. 7 is a sectional view similar to FIG. 3 showing an another embodiment of the ovenable label having only a promotional layer and a barrier layer.
Figure 8:
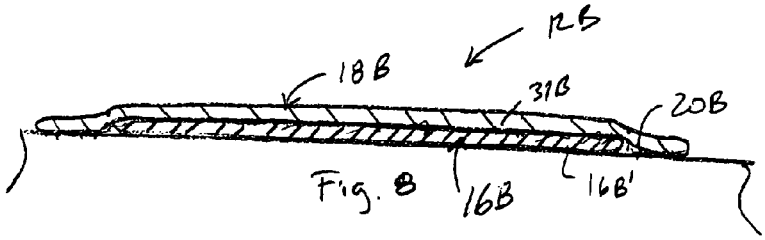
FIG. 8 is a sectional view of the embodiment of FIG. 7 albeit having a single ply promotional layer.

FIGS. 7 and 8 show two other alternate embodiments of the ovenable label 12B in which there is no base layer, only a heat resistant barrier layer 18B that covers a promotional layer 16B and adheres directly to the product packaging 10B along one or more sides of the promotional layer 16B. The promotional layer can be a single ply 16B' (FIG. 8) or multiple ply 16B" (shown folded in FIG. 7), and can be of a heat resistant material (e.g., polyester) or non-heat resistant material (e.g., paper). Like the above-described embodiment, the adhesive 20B can be a permanent or semi-permanent pressure sensitive heat resistant and transparent adhesive that securely affixes the label to the product package, and the barrier layer 18B (and possible the promotional layer 16B) can be perforated to define a lift off section 31B for removing some or all of the promotional layer 16B. The label of this embodiment can be formed in a continuous line assembly process very similar to that described above (albeit without the base layer) in which multiple labels are adhered to a release liner.

Figure 9:
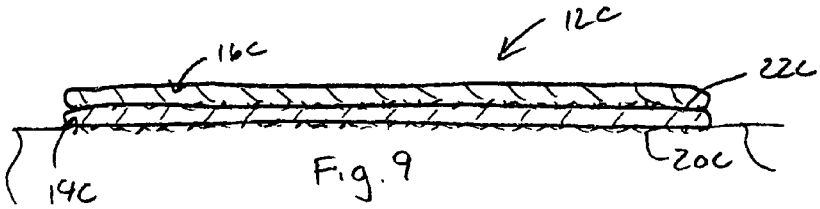
FIG. 9 is another embodiment of the ovenable label having a two heat resistant layers in which the upper promotional layer is releasably adhered to the base layer.

FIG. 9 illustrates another embodiment of the ovenable label 12C in which there are only two layers, however, here there is no overlaminate or barrier layer. In this embodiment, both the promotional layer 16C and the base layer 14C are made of a heat resistant material, such as polyester, particularly one having (or treated to have) good printability for the promotional layer. Like before, the base layer adheres directly to the product packaging along one or more sides with a permanent or semi-permanent transparent heat resistant pressure sensitive adhesive 20C. Here, however, rather than perforating one or more layers of the label, a transparent heat resistant adhesive 22C is applied to the base layer. This allows the entire promotional layer to be peeled from the base layer without parts of a barrier layer being attached or remnants of the promotional layer being left behind. The entire base layer remains attached to the ovenable package because its adhesion is greater than that between the mating layers. The adhesive leaves the peeled off promotional layer non-tacky or minimally tacky and easy to handle. The ovenable label of this embodiment can still be formed in a continuous line assembly process very similar to that described above (albeit without the barrier layer) in which multiple labels are adhered to a release liner.

The present invention thus provides a high temperature ovenable label, product and package, which can be used applying promotional items, such as coupons, to the ovenable packaging of food products and other products that are placed in an oven while still in their packaging. The ovenable label can be comprised of one or more layers of plastic film providing a heat barrier for a low cost paper layer printed to define the promotional item. The labels can be assembled in a continuous line manner and self-adhered to the packaging.

While there has been shown and described what are at present considered to be the preferred embodiments of the invention, it will be obvious to those skilled in the art that various changes and modifications can be made to the described embodiments without departing from the scope of the present invention. Accordingly, to ascertain the full scope of the invention, reference must be had to the following claims.

What is claimed is:

1. In an ovenable package containing contents to be heated in an oven, a heat resistant label mounted to a display surface of the package, said heat resistant label comprising:

a base layer permanently secured on the display surface of the ovenable package;

a barrier layer overlying said base layer, said barrier layer having first portions thereof which are secured to corresponding portions of said base layer and having a second portion which is wholly separable from said first portions; and a promotional layer that is removable from the package, said promotional layer located intermediate said barrier layer and said base layer, having one surface in contact with said second portion of said barrier layer and having another surface in contact with said base layer, said promotional layer being separable from the base layer and;

wherein the package and said label including said promotional layer are suitable for withstanding oven temperatures that are substantially above the auto-ignition point the material of the promotional layer.

2. A package as defined in claim 1, wherein at least one of said barrier layer and said base layer is transparent polyester.

3. A heat resistant label for placement on a display surface of an ovenable package, said heat resistant label comprising:

a base layer for adhesively-secured placement on the display surface of the ovenable package, said base layer being made of a heat resistant material;

a barrier layer overlying said base layer, said barrier layer having first portions thereof which are secured to corresponding portions of said base layer and having a second portion which is separable from said first portions of said barrier layer, said second portion also being removable from said base layer, said barrier layer being made of a heat resistant material; and a promotional layer located intermediate said barrier layer and said base layer, said promotional layer having one surface in contact with said second portion of said barrier layer and having another surface in contact with said base layer, said promotional layer being separable from the base layer and being made of a material having an auto-ignition point at a first temperature;

wherein said heat resistant label is suitable for resisting oven temperatures in excess of said first temperature without sustaining significant damage to said promotional layer; and wherein said second portion of said barrier layer may be removed to allow the removal of said promotional layer from said heat resistant label.

4. A heat resistant label as defined in claim 3, wherein said base layer is made of a heat resistant polyester material.

5. A heat resistant label as defined in claim 3, wherein said base layer is substantially transparent.

6. A heat resistant label as defined in claim 3, wherein said barrier layer is made of a heat resistant polyester material.

7. A heat resistant label as defined in claim 3, wherein said barrier layer is substantially transparent.

8. A heat resistant label as defined in claim 3, wherein said promotional layer is made from paper.

9. A heat resistant label as defined in claim 3, wherein said promotional layer is made of plastic material.

10. A heat resistant label as defined in claim 3, wherein said promotional layer defines a coupon.

11. A heat resistant label as defined in claim 3, wherein said barrier layer is substantially the same size and of substantially the same configuration as said base layer.

12. A heat resistant label as defined in claim 3, wherein said promotional layer is approximately the same size and configuration as said second portion of said barrier layer.

13. A heat resistant label as defined in claim 3, wherein said barrier area includes areas of structural weakness intermediate said second portion of said barrier layer and said first portions of said barrier layer to facilitate removal of said second portion of said barrier layer from said first portions of said barrier layer and said base layer to provide access to said promotional layer.

14. A heat resistant label as defined in claim 13, wherein said areas of structural weakness comprise perforation lines.

15. A heat resistant label as defined in claim 13, wherein said first portions of said barrier layer comprise two opposite side wings that are secured to said base layer.

16. A heat resistant label as defined in claim 13, wherein said first portions of said barrier layer comprise four side wings located about the perimeter of said barrier layer that are secured to said base layer.

17. A heat resistant label as defined in claim 3, additionally comprising a pressure-sensitive adhesive located on the side of said base layer opposite said barrier layer to secure said base layer to the display surface of the ovenable package.

18. A heat resistant label as defined in claim 17, additionally comprising a web of release liner, said base layer being removably secured to said web of release liner prior to installation of said heat resistant label on the ovenable package.

19. A heat resistant label as defined in claim 3, additionally comprising a pressure-sensitive adhesive located on the side of said first portions of said release layer facing said base layer to secure said release layer to said base layer.

20. A product containing contents to be heated in an oven, comprising:

an ovenable package containing the contents and defining a display surface thereupon; and a heat resistant label adhered at an underside to the display surface, said heat resistant label comprising:

a base layer for adhesively-secured placement on the display surface of the ovenable package, said base layer being made of a heat resistant material;

a barrier layer overlying said base layer, said barrier layer having first portions thereof which are secured to corresponding portions of said base layer and having at least one second portion which is detachable from said first portions of said barrier layer and said base layer, said barrier layer being made of a heat resistant material;

a promotional layer that is at least in part removable from the package, said promotional layer located intermediate said barrier layer and said base layer, said promotional layer having one surface in contact with one of said at least one second portions of said barrier layer and having another surface in contact with said base layer and detachable and separable from said base layer, said promotional layer being made of a material having an auto-ignition point at a first temperature;

wherein the package and the entire label and the promotional layer are suitable for resisting oven temperatures substantially above said first temperature without sustaining significant damage to said promotional layer.

21. A product as defined in claim 20, wherein said promotional layer is made of paper.

22. A product as defined in claim 20, wherein said promotional layer is made of plastic.

23. A product as defined in claim 20, wherein at least one of said barrier layer and said base layer is made of a heat resistant polyester.

24. A product as defined in claim 23, wherein at least one of said barrier layer and said base layer is transparent.

25. A product as defined in claim 20, wherein said barrier layer and said base layer are larger than said promotional layer.

26. A product of claim 25, wherein said barrier layer further comprises perforations to allow separation of said at least one second portion of said barrier layer from said first portions of said base layer and said base layer and access to said promotional layer.

27. A product of claim 26, wherein said at least one second portion of said barrier layer defines a lift off section with opposite edges defined by at least two perforation lines.

28. A product of claim 27, wherein said lift off section is defined by four perforation lines.

29. A product of claim 26, wherein said barrier layer is adhered to said promotional layer.

30. A product of claim 29, wherein an underside of said barrier layer is coated with a pressure sensitive adhesive.

31. A product of claim 20, wherein said promotional layer of said heat resistant label is releasably adhered to said base layer.

32. A product of claim 31, wherein said promotional and base layers are made of a heat resistant polyester.

33. A product of claim 20, wherein said promotional layer defines a coupon.

34. A method of providing a promotional item to a consumer, the method comprising:

obtaining a heat resistant package and said heat resistant label according to claim 20;

placing the contents to be heated into the interior space of the package; and adhering said heat resistant label to the display surface of the package.

35. A method as defined in claim 34, further comprising:

placing the package into an oven and heating the contents;

removing the package from the oven; and optionally removing said promotional layer of said heat resistant label from the display surface of the package.

* * * * *